US005676592A

United States Patent [19]

Borgatti

[11] Patent Number: 5,676,592

[45] Date of Patent: Oct. 14, 1997

[54] DUAL-LIGHT ASSEMBLY FOR BENCH GRINDERS

[75] Inventor: Anthony J. Borgatti, East Longmeadow, Mass.

[73] Assignee: Power Tool Specialists, Inc., East Windsor, Conn.

[21] Appl. No.: 724,776

[22] Filed: Oct. 3, 1996

[51] Int. Cl.[6] ..... B24B 9/00; B24B 53/14

[52] U.S. Cl. ..... 451/454; 451/361; 451/451

[58] Field of Search ..... 451/178, 231, 451/360, 361, 341, 454, 457, 451; 125/11.03; 248/121, 122.1, 124.1, 125.2, 205.1, 207, 220.31, 226.11

[56] References Cited

U.S. PATENT DOCUMENTS

| | | | |
|---|---|---|---|
| 2,167,310 | 7/1939 | Orgitano | 51/166 |
| 4,578,907 | 4/1986 | Cayley et al. | 451/451 |
| 4,829,722 | 5/1989 | Yang | 451/451 |
| 4,955,162 | 9/1990 | Jackson | 451/451 |
| 5,500,989 | 3/1996 | Ford et al. | 451/451 |
| 5,525,095 | 6/1996 | Baughman | 451/72 |

OTHER PUBLICATIONS

Grainger® Industrial and Commercial Equipment and Supplies, 1994 General Catalog No. 385, p. 1293.

Power Tool Specialist, Inc. Catalog, pp. 20 and 21, 1995.

*Primary Examiner*—Eileen P. Morgan

*Attorney, Agent, or Firm*—McCormcik, Paulding & Huber

[57] ABSTRACT

A dual-light assembly is provided for a bench grinder having a centrally-located motor housing, two laterally-projecting wheel housings mounted on opposite sides of the motor housing relative to each other, a grinding wheel or wire brush rotatably mounted within each wheel housing and defining a respective work station, and a shield assembly mounted to each wheel housing by a shield fastener and including a transparent shield mounted over a respective work station. Two lamp brackets of the dual-light assembly each define a mounting wall forming an elongated slot for receiving a respective shield fastener, and clamping the lamp bracket between the associated wheel housing and mounting arm of the shield assembly. Each shield fastener is slidable through the respective elongated slot for adjusting the position of the bracket relative to the respective work station. Each lamp bracket further defines a lamp flange projecting inwardly from the mounting wall of the bracket in a direction approximately toward the motor housing. Two lamp fixtures are each mounted on a respective lamp flange and located to one side of a respective shield for receiving a light bulb and illuminating the respective work station. A toggle switch is mounted in a junction housing and is electrically connected to each lamp fixture, and a layer of pressure-sensitive adhesive is mounted to the base of the junction housing for fixedly securing the junction housing to the motor housing.

14 Claims, 3 Drawing Sheets

DUAL-LIGHT ASSEMBLY FOR BENCH GRINDERS

FIELD OF THE INVENTION

The present invention relates to bench grinders of the type having a centrally-positioned motor and two laterally-projecting work stations with a grinding wheel, wire brush or like tool rotatably mounted in each work station, and more particularly, to light assemblies for illuminating the work stations in such bench grinders.

BACKGROUND INFORMATION

A typical bench grinder includes a centrally-located motor housing mounted on a pedestal or like base, and two laterally-projecting wheel housings mounted on opposite sides of the motor housing relative to each other. Each wheel housing encloses a rotatably-mounted grinding wheel, wire brush or like tool defining a respective work station. A protective shield assembly is typically mounted to each wheel housing, and includes a transparent shield mounted over the respective work station to protect an operator from chips, dust or other debris.

Many such bench grinders are provided with a centrally-positioned lamp having a gooseneck support mounted to the base of the grinder so that the position of the lamp can be manipulated to direct the light onto one or the other of the work stations. More recently, bench grinders have been provided with dual-lamp assemblies. For example, U.S. Pat. No. 5,525,095 to Baughman shows a bench grinder comprising a transparent shield mounted over each grinding station, and a lamp attached to each shield to illuminate the shield and thereby illuminate the station.

One of the drawbacks of this type of illumination system is that it does not lend itself to retrofitting existing bench grinders. Rather, this system requires that the lamps and shields be specially configured to form an integral lamp and shield assembly so that each lamp may illuminate the respective shield to in turn illuminate a work station. There are hundreds of thousands of bench grinders in use, and numerous brands of bench grinders currently for sale which do not include dual-light assemblies.

Accordingly, it is an object of the present invention to provide a dual-light assembly which may be furnished in kit form to retrofit existing bench grinders, or which may also be easily and relatively inexpensively incorporated by original equipment manufacturers into new bench grinders.

SUMMARY OF THE INVENTION

The present invention is directed to a dual-light assembly for a bench grinder having a motor housing, two wheel housings mounted on opposite sides of the motor housing relative to each other, and a wheel-like tool rotatably mounted within each wheel housing and defining a respective work station. Two protective-shield assemblies each include a mounting arm extending adjacent to a side wall of a respective wheel housing, and a transparent shield supported by the mounting arm and extending over a respective work station. Each mounting arm is secured to the wheel housing by a respective shield fastener. The dual-light assembly comprises two lamp brackets, and each lamp bracket includes a mounting wall defining a fastener aperture, and a lamp flange projecting outwardly from the mounting wall in a direction approximately transverse to a plane of the mounting wall. Each mounting wall is seated adjacent to a respective mounting arm with the associated shield fastener received through the fastener aperture and secured to the wheel housing, to thereby clamp the mounting wall between the shield fastener and wheel housing and lock the lamp bracket in place. Two lamp fixtures are each mounted on a respective lamp flange and located adjacent to a respective shield for receiving a light bulb and illuminating the respective work station.

In one embodiment of the present invention the dual-light assembly is provided in kit form for retrofitting existing bench grinders, and includes a junction box electrically connected to each lamp fixture, and a layer of pressure-sensitive adhesive for fixedly securing the junction box to the motor housing. The junction box preferably includes a mounting surface defining a curvature approximately conforming to a curvature of the motor housing, and the layer of pressure-sensitive adhesive is interposed between the mounting surface and motor housing to adhesively attach the junction box to the motor housing.

One advantage of the dual-light assembly of the present invention is that it may be used to retrofit existing bench grinders without requiring any tools or expertise. The mounting wall of each lamp bracket may be seated between the wheel housing and mounting arm of the adjacent protective shield assembly, and each lamp bracket may be fixed in place by securing the respective shield fastener through the fastener aperture of the mounting wall. The dual-light assembly of the invention is therefore adapted to fit any of numerous different commercially-available bench grinders.

Other objects and advantages of the present invention will become apparent in view of the following detailed description and accompanying drawings.

DETAILED DESCRIPTION OF A PREFERRED EMBODIMENT

Figure 1:
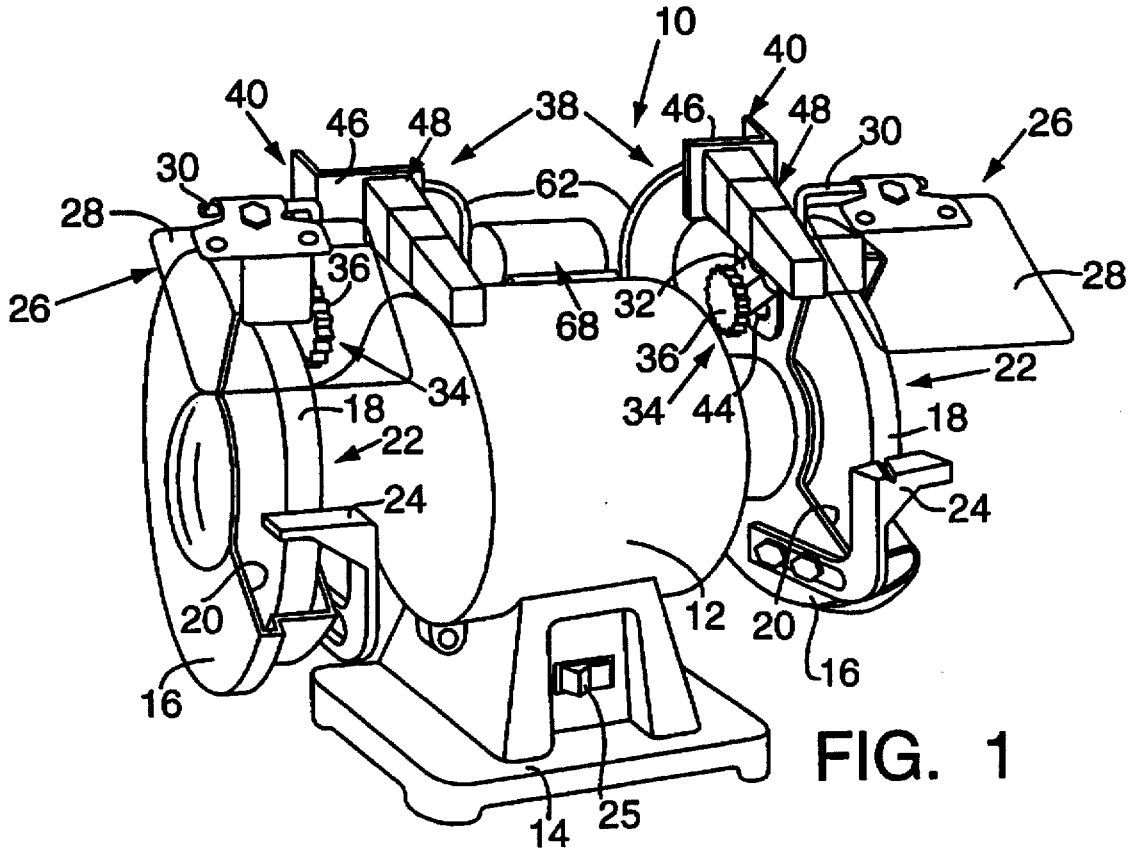
FIG. 1 is a perspective view of a typical bench grinder including a dual-light assembly embodying the present invention.

In FIG. 1 a typical bench grinder having a dual-light assembly embodying the present invention is indicated generally by the reference numeral 10. The bench grinder 10 comprises a centrally-located motor housing 12 mounted on a pedestal or base 14. Two laterally-projecting wheel housings 16 are mounted on opposite sides of the motor housing relative to each other, and a wheel-like tool 18 is rotatably mounted within each wheel housing. Each tool 18 may be a grinding wheel, wire brush or like tool known to those of ordinary skill in the pertinent art for use on a bench grinder. As shown in FIG. 1, each wheel housing 16 defines an opening 20 on the front side of the grinder for accessing each grinding wheel or like tool 18 and forming a respective work station 22. A tool rest 24 is fixedly mounted to each wheel housing 16, and projects upwardly into the work station 22 adjacent to the respective grinding wheel 18 for providing a support surface for grinding, brushing or otherwise working on a tool or other type of workpiece. An "on/off" switch 25 is mounted in the base 14 of the grinder and is connected between a power cord (not shown) and the motor to actuate the grinding wheels.

A shield assembly 26 is mounted to each wheel housing 16, and each shield assembly includes a transparent shield 28 pivotally mounted on an L-shaped support arm 30. As shown in FIG. 1, each transparent shield 28 overlies the respective work station 22 to protect an operator from chips, dust and other debris when using the respective work station. As shown typically in FIG. 1, each L-shaped support arm 30 is received within a mounting bracket 32, and each mounting bracket is in turn fixedly secured to the respective wheel housing by a shield fastener 34 extending through an aperture in the bracket (not shown). The shield fastener 34 may be any of numerous types of fasteners known to those skilled in the pertinent art. In the embodiment of the present invention illustrated, each fastener 34 is a threaded fastener which is received within a corresponding threaded aperture (not shown) formed in the respective wheel housing, and includes a knob 36 to facilitate manual attachment and detachment of the fastener.

Figure 2:
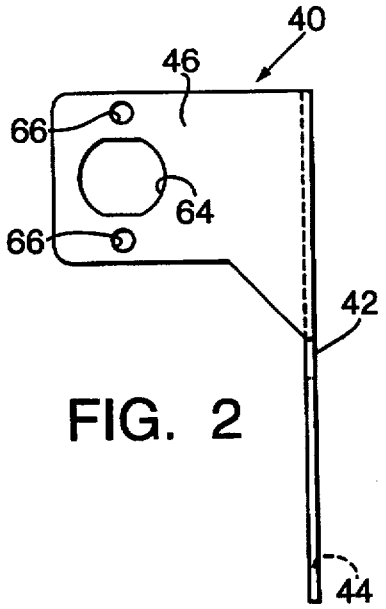
FIG. 2 is a front elevational view of a typical lamp bracket of the dual-light assembly of FIG. 1.

The bench grinder 10 further comprises a dual-light assembly 38 including two lamp brackets 40, each fixedly mounted to the inner wall of a respective wheel housing 16 by the respective shield fastener 34. As shown best in FIGS. 2 and 3, each lamp bracket 40 includes a planar mounting wall 42 defining an axially-elongated slot 44 for receiving the respective shield fastener 34, and a lamp flange 46 lying within a plane approximately perpendicular to the plane of the mounting wall. As shown in FIG. 1, each lamp flange 46 projects inwardly from the respective wheel housing approximately toward the center of the bench grinder or motor housing 12, and a lamp fixture 48 is mounted to each flange.

Figure 4:
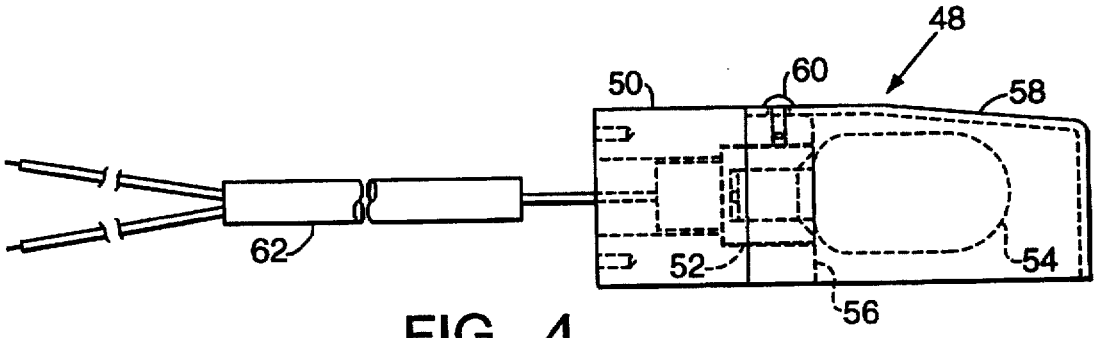
FIG. 4 is a side elevational view of a typical lamp fixture of the dual-light assembly of FIG. 1.

As shown typically in FIG. 4, each lamp fixture 48 comprises a lamp housing 50 and a lamp socket 52 mounted within the housing for threadedly receiving a light bulb 54 (shown in phantom). As also shown in FIG. 4, each lamp housing 50 defines a recessed flange 56 for receiving and aligning a lamp shade 58 on the housing with the shade overlying the light bulb. A fastener 60 is used to fixedly attach each lamp shade to its respective lamp housing. An electrical lamp cord 62 is electrically connected to each lamp socket 52, and projects outwardly from the base of the housing 50 for attachment to a suitable power source, as is described further below. As shown typically in FIG. 2, each lamp flange 46 defines a strain-relief aperture 64 which is shaped and dimensioned to receive a strain-relief bushing (not shown) attached to the power cord 62 of the respective lamp fixture 48, and two mounting apertures 66 for mounting the respective lamp housing 50 to the flange with suitable fasteners (not shown).

As shown in FIG. 1, each lamp cord 62 is electrically connected to a junction box 68 mounted to the motor housing 12. As shown best in FIGS. 5 and 6, the junction box 68 includes a junction housing 70 and an electrical switch 72 connected between the two lamp cords 62 and a power cord 74. The power cord 74 includes a plug or like connector (not shown) for connection to an electrical wall outlet or other suitable power source. In the embodiment of the present invention illustrated, the switch 72 is a toggle switch and is configured to simultaneously connect both lamp chords 62 to the power cord 74 when moved to its "ON" position to thereby illuminate both lamp fixtures. However, as will be recognized by those skilled in the pertinent art, more than one switch may be provided, or any of numerous different switch types may be employed to alternately illuminate the two lamp fixtures, or to permit an operator to select between alternate and simultaneous illumination of the two lamp fixtures.

Figure 5:
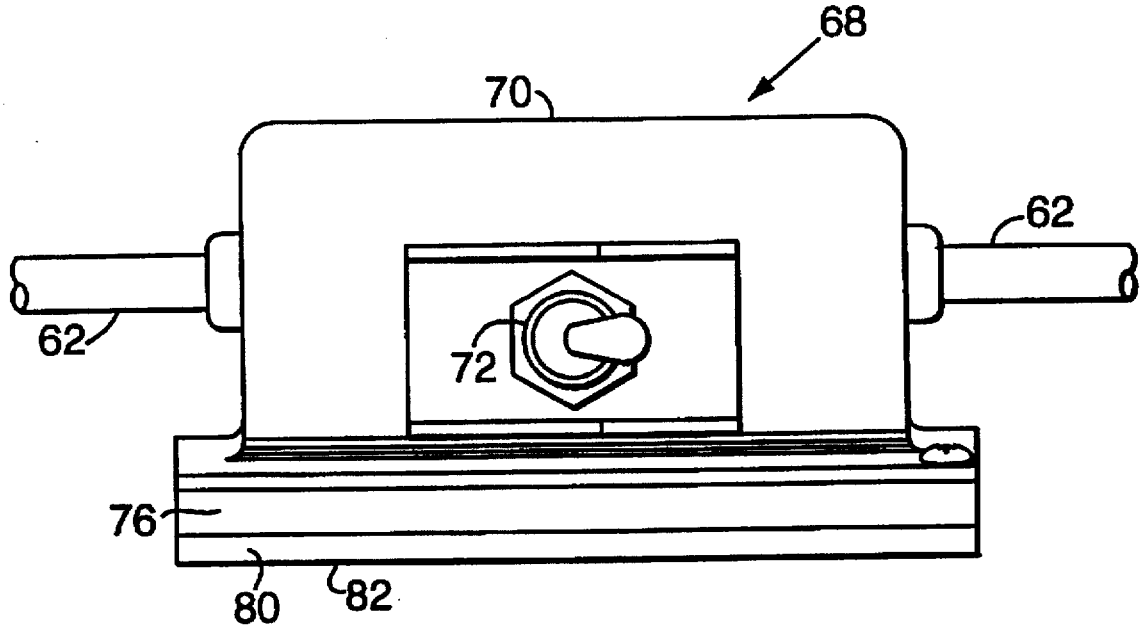
FIG. 5 is a front elevational view of the junction box of the dual-light assembly of FIG. 1, including an electrical switch for controlling operation of the lamp fixtures.
Figure 6:
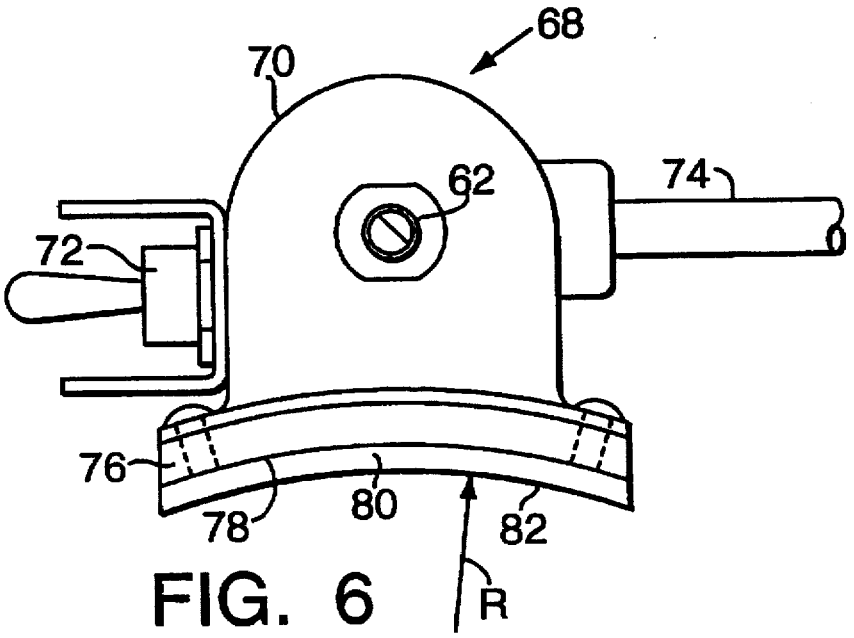
FIG. 6 is a side elevational view of the junction box of FIG. 5.

As also shown in FIGS. 5 and 6, the junction box 68 includes a mounting plate 76 attached to the base of the housing 70 and defining a mounting surface 78 which is shaped to conform to the contour of the motor housing 12. As shown in FIG. 6, the contour of the mounting surface 78 is defined by a radius "R" which is approximately equal to the outside radius of the cylindrical portion of the motor housing 12. A layer of pressure-sensitive adhesive 80 is attached to the mounting surface 78, and includes a releasable backing 82 for removal prior to attachment of the junction box to the motor housing. In the embodiment of the present invention illustrated, the layer of pressure-sensitive adhesive 80 is formed by a double-sided foam tape so that it may be adhesively attached on one side to the mounting plate 76 and attached on the other side to the motor housing (or other desired mounting surface). However, as will be recognized by those skilled in the pertinent art, any of numerous known types of pressure-sensitive adhesives may be employed, wherein, for example, the layer consists of an adhesive foam, or alternatively, the layer consists of a polymeric material with an adhesive coating applied to one or both of its sides.

In order to retrofit an existing bench grinder, each shield fastener 34 of FIG. 1 is removed from the respective wheel housing 16, and each lamp bracket 40 is installed with its mounting wall 42 seated between the inside wall of the respective wheel housing 16 and the mounting arm 30 and mounting bracket 32 of the shield assembly. Each shield fastener 34 is then inserted through the elongated slot 44 of the respective lamp bracket and into the corresponding threaded aperture (not shown) of the wheel housing. When each shield fastener 34 is threadedly attached to the respective wheel housing, the mounting wall 42 of the respective lamp bracket is clamped between the associated mounting arm 30 (or mounting bracket 32) and the wheel housing 16 to thereby fixedly secure the lamp fixture and protective shield assembly in place. As shown in FIG. 1, because the lamp flanges 46 project inwardly toward the motor housing, each lamp fixture 48 is preferably mounted to one side of the respective transparent shield 28 and work station 22 to avoid or minimize any glare that might otherwise be caused by reflections off the transparent shields.

The junction box 68 is then mounted to the motor housing 12 by removing the releasable backing 82 on the layer of pressure-sensitive adhesive 80, and pressing the adhesive layer into contact with the motor housing at the desired location. The surface of the motor housing receiving the junction box is preferably cleaned with a suitable solvent or cleanser to remove any dirt, grease or other debris, and to thereby facilitate attachment of the pressure-sensitive adhesive to the housing.

The position of each lamp fixture 48 may be easily adjusted by loosening the respective shield fastener 34, and by pivoting the lamp bracket about the respective shield fastener, and/or by moving the lamp bracket up or down with the fastener slidably received through the elongated slot to adjust the vertical position of the bracket. Once the desired position of each lamp fixture is obtained, the respective shield fastener 34 is rotated to lock each lamp bracket in place.

Figure 3:
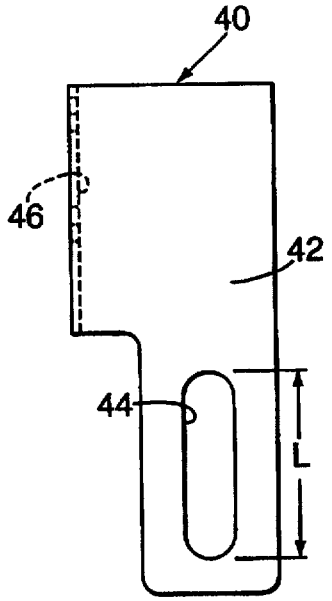
FIG. 3 is a side elevational view of the lamp bracket of FIG. 2.

One advantage of the dual-light assembly of the present invention is that the position of each lamp fixture may be easily adjusted relative to the respective grinding wheel or work station as described, in order to minimize reflection and glare, and to otherwise position and direct the illumination of each lamp as desired. In addition, the light assembly may be used for any of numerous different size bench grinders. Commercially-available bench grinders are produced in various sizes, typically with 5 inch, 6 inch or 8 inch diameter grinding wheels. As shown in FIG. 3, the length "L" of the elongated slot 44 in each lamp bracket is preferably dimensioned so that the vertical position of each lamp bracket may be adjusted to accommodate any of various grinding wheel sizes. In the embodiment of the present invention illustrated, the length "L" is at least approximately 1.25 inches.

Yet another advantage of the present invention is that it may be provided in the form of a retrofit kit comprising a pair of lamp bracket and fixture assemblies and a junction box with power cord, and the kit may be applied to easily retrofit existing bench grinders to include the dual-light assembly without the need for any tools or expertise.

As will also be recognized by those skilled in the pertinent art, the dual-light assembly of the invention may equally be employed in the manufacture of new bench grinders. In this case, there would be no need for a separate junction box. Rather, each lamp cord 62 could be connected to the "on/off" switch 25 of the bench grinder so that both lights would be automatically illuminated upon operating the grinder, or alternatively, the lamp cords could be connected to one or more separate light switches as described above. In addition, it would not be necessary to mount the lamp brackets on different bench grinders, and therefore the brackets would not require the elongated slot 44, but rather could include a single aperture corresponding to the exact shape of the shield fastener (for example, a round aperture).

As will also be recognized by those skilled in the pertinent art, it may be desirable to mount separate switches on each lamp fixture in order to separately control each lamp, rather than employ one or more switches in the junction box, as described above. In this situation, the junction box 68 would not require a switch 72, but rather may be provided only for purposes of electrically connecting the two lamp cords to the power cord. Alternatively, the lamp cords in this type of construction could be joined to the power cord in another type of junction box or suitable connector, which need not be adhesively mounted or otherwise attached to the motor housing.

As will also be recognized by those skilled in the pertinent art, rather than form the elongated slot 44 in each lamp bracket, it may be desirable to form a series of fastener apertures in each mounting wall to permit incremental adjustment of the lamp bracket (as opposed to infinitesimal adjustment) for use with different types or sizes of bench grinders.

Accordingly, numerous changes and modification may be made to the above described and other embodiments of the present invention without departing from its scope as defined in the appended claims. This detailed description of a preferred embodiment should therefore be taken in an illustrative, as opposed to a limiting sense.

I claim:

1. A dual-light assembly for a bench grinder having a motor housing, two wheel housings mounted on opposite sides of the motor housing relative to each other, a wheel-like tool rotatably mounted within each wheel housing and defining a respective work station, two shield assemblies, each shield assembly including a mounting arm extending adjacent to a side wall of a respective wheel housing, a transparent shield supported by the mounting arm and extending over a respective work station, and a shield fastener securing the mounting arm to the respective wheel housing, the dual-light assembly comprising:

two lamp brackets, each lamp bracket including a mounting wall defining a fastener aperture, and a lamp flange projecting outwardly relative to the mounting wall in a direction approximately transverse to a plane of the mounting wall, each mounting wall being seated adjacent to a respective mounting arm with the associated shield fastener received through the fastener aperture and secured to the wheel housing to thereby clamp the mounting wall between the shield fastener and wheel housing and lock the lamp bracket in place; and two lamp fixtures, each lamp fixture being mounted on a respective lamp flange and located to one side of a respective shield for receiving a lamp and illuminating the respective work station.

2. A dual-light assembly as defined in claim 1, wherein each lamp flange is substantially located within a plane approximately perpendicular to the respective mounting wall.

3. A dual-light assembly as defined in claim 1, further comprising a junction housing electrically connected to each lamp fixture, and including a layer of pressure-sensitive adhesive for attachment of the junction housing to the motor housing.

4. A dual-light assembly as defined in claim 3, wherein the junction housing includes a mounting surface defining a curvature approximately conforming to a curvature of the motor housing, and the layer of pressure-sensitive adhesive is interposed between the mounting surface and motor housing to adhesively attach the junction housing to the motor housing.

5. A dual-light assembly as defined in claim 3, wherein the layer of pressure-sensitive adhesive if formed by a layer double-sided foam tape.

6. A dual-light assembly as defined in claim 1, wherein each fastener aperture is defined by an elongated slot permitting slidable movement of the shield fastener through the slot for adjusting the position of each lamp bracket relative to the respective work station.

7. A dual-light assembly as defined in claim 1, wherein each lamp fixture is spaced inwardly from the respective transparent shield in a direction approximately toward the motor housing.

8. A dual-light assembly as defined in claim 1, wherein each lamp fixture includes a lamp socket mounted to the respective lamp flange and located to one side of the respective shield for receiving a light bulb.

9. A dual-light assembly as defined in claim 8, wherein each lamp fixture further includes a lamp shade supported on a respective lamp flange and overlying a light bulb received within the respective lamp socket.

10. A dual-light assembly for a bench grinder having a motor housing, two wheel housings mounted on opposite sides of the motor housing relative to each other, a wheel-like tool rotatably mounted within each wheel housing and defining a respective work station, two shield assemblies, each shield assembly including a mounting arm extending adjacent to a side wall of a respective wheel housing, a transparent shield supported by the mounting arm and extending over a respective work station, and a shield fastener securing the mounting arm to the respective wheel housing, the dual-light assembly comprising:

two lamp fixtures, each lamp fixture being mounted on a respective lamp bracket and located to one side of a respective shield for receiving a lamp and illuminating the respective work station, and means for mounting each lamp bracket between a respective shield fastener and wheel housing to clamp the bracket between the fastener and housing and lock the bracket in place.

11. A dual-light assembly as defined in claim 1, wherein the means for mounting includes an approximately planar mounting surface defined by each lamp bracket, and a fastener aperture formed through each planar mounting surface for receiving the respective shield fastener to clamp the bracket between the fastener and housing and lock the bracket in place.

12. A dual-light assembly as defined in claim 11, wherein each mounting bracket defines a lamp flange projecting outwardly relative to the planar mounting surface in a direction transverse relative to the mounting surface, and each lamp fixture is mounted to a respective lamp flange.

13. A dual-light assembly as defined in claim 10, further comprising a junction housing electrically connected to each lamp fixture, and including a layer of pressure-sensitive adhesive for attachment of the junction housing to the motor housing.

14. A dual-light assembly as defined in claim 11, wherein each fastener aperture is defined by an elongated slot permitting slidable movement of the shield fastener through the slot for adjusting the position of each Lamp bracket relative to the respective work station.

* * * * *